US010584862B2

(12) United States Patent
Kim et al.

(10) Patent No.: US 10,584,862 B2
(45) Date of Patent: Mar. 10, 2020

(54) LIGHTING DEVICE

(71) Applicant: LG INNOTEK CO., LTD., Seoul (KR)

(72) Inventors: Min Ji Kim, Seoul (KR); Do Yub Kim, Seoul (KR); Min Hak Kim, Seoul (KR); Yeong Seok Yu, Seoul (KR)

(73) Assignee: LG Innotek Co., Ltd., Seoul (KR)

( * ) Notice: Subject to any disclaimer, the term of this patent is extended or adjusted under 35 U.S.C. 154(b) by 24 days.

(21) Appl. No.: 16/082,494

(22) PCT Filed: Mar. 10, 2017

(86) PCT No.: PCT/KR2017/002625
§ 371 (c)(1),
(2) Date: Sep. 5, 2018

(87) PCT Pub. No.: WO2017/155354
PCT Pub. Date: Sep. 14, 2017

(65) Prior Publication Data

US 2019/0101277 A1 Apr. 4, 2019

(30) Foreign Application Priority Data

Mar. 11, 2016 (KR) ..... 10-2016-0029446

(51) Int. Cl.
*F21V 19/00* (2006.01)
*F21V 29/505* (2015.01)
(Continued)

(52) U.S. Cl.
CPC ..... *F21V 29/70* (2015.01); *F21V 19/001* (2013.01); *F21V 29/505* (2015.01); *F21V 29/507* (2015.01); *F21V 29/15* (2015.01)

(58) Field of Classification Search
CPC ..... F21V 19/00; F21V 19/001; F21V 29/70; F21V 29/502; F21V 29/505;
(Continued)

(56) References Cited

U.S. PATENT DOCUMENTS 7,293,898 B2 * 11/2007 Kumthampinij ..... F21L 4/027 362/184
8,066,392 B2 * 11/2011 Wang ..... F21S 9/022 362/20
(Continued)

FOREIGN PATENT DOCUMENTS

JP 2010-049830 3/2010
JP 2012-069487 4/2012
(Continued)

OTHER PUBLICATIONS

International Search Report (with English Translation) and Written Opinion dated May 29, 2017 issued in Application No. PCT/KR2017/002625.

*Primary Examiner* — Arman B Fallahkhair
(74) *Attorney, Agent, or Firm* — KED & Associates, LLP

(57) ABSTRACT

An embodiment comprises: a board; a light-emitting module including at least one light-emitting element arranged in a first region of the board and a driving element, arranged in a second region of the board, for driving the at least one light-emitting element; a heat-dissipating member disposed below the lower surface of the board; and a heat-dissipating pad disposed between the board and the heat-dissipating member, wherein the heat-dissipating pad comprises: a heat-dissipating plate disposed on the upper surface of the heat-dissipating member; and a protruding part protruding from the upper surface of the heat-dissipating plate and supporting the lower surface of the first region of the board, and the lower surface of the board is spaced apart from the heat-dissipating plate.

19 Claims, 12 Drawing Sheets

(51) Int. Cl.
*F21V 29/507* (2015.01)
*F21V 29/70* (2015.01)
*F21V 29/15* (2015.01)

(58) Field of Classification Search
CPC ..... F21V 29/507; F21V 29/15; F21V 29/74; F21V 7/041; F21V 23/005; F21V 21/04
See application file for complete search history.

(56) References Cited

U.S. PATENT DOCUMENTS

| | | | | |
|---|---|---|---|---|
| 8,573,816 | B2 * | 11/2013 | Negley | G02B 1/041 362/362 |
| 8,602,593 | B2 * | 12/2013 | Markle | F21K 9/00 362/249.02 |
| 9,028,086 | B2 * | 5/2015 | Woo | F21V 7/04 362/294 |
| 9,927,074 | B2 * | 3/2018 | Kim | F21K 9/00 |
| 2012/0033419 | A1 | 2/2012 | Kim et al. | |
| 2013/0271997 | A1 | 10/2013 | Kim et al. | |
| 2015/0029733 | A1 | 1/2015 | Yoo et al. | |

FOREIGN PATENT DOCUMENTS

| | | |
|---|---|---|
| JP | 2013-222709 | 10/2013 |
| KR | 10-1055743 | 8/2011 |
| KR | 10-2012-0006714 | 1/2012 |
| KR | 10-1230620 | 2/2013 |
| KR | 10-1248731 | 4/2013 |
| KR | 10-2015-0011540 | 2/2015 |

* cited by examiner

| Test Point Temperature (°C) | | | | | | | | | | | |
|---|---|---|---|---|---|---|---|---|---|---|---|
| Ts 1 | Ts 2 | 116-6 | 116-7 | 116-2 | 116-1 | 116-5 | 116-8 | 116-4 | 116-3 | 120 | External Air |
| 74.1 | 72.5 | 63.3 | 60.9 | 69.5 | 74.1 | 80.5 | 69.0 | 63.4 | 52.1 | 54.0 | 25.0 |

LIGHTING DEVICE

CROSS-REFERENCE TO RELATED PATENT APPLICATIONS

This application is a U.S. National Stage Application under 35 U.S.C. § 371 of PCT Application No. PCT/KR2017/002625, filed Mar. 10, 2017, which claims priority to Korean Patent Application No. 10-2016-0029446, filed Mar. 11, 2016, whose entire disclosures are hereby incorporated by reference.

TECHNICAL FIELD

Embodiments relate to lighting devices.

BACKGROUND ART

A lighting device, which includes an LED module adapted to be driven by AC power, typically includes a plurality of LED elements disposed on a substrate and at least one drive element (for example, a driver IC, a bridge diode and a condenser) disposed adjacent to the LED elements.

A light source suitable for an LED module may be of a package type. In this case, the efficiency of heat dissipation may be decreased, and manufacturing costs may be increased. Furthermore, since the drive element, disposed adjacent to the LED elements, may absorb light, light loss may be generated.

In addition, due to heat generated from the LED elements, the drive element, disposed adjacent to the LED elements, may be damaged by the heat.

Technical Object

Embodiments provide a lighting device, which is capable of preventing shortening of life of drive elements attributable to heat generated from heat-emitting elements and of preventing electrical shorts between drive elements bonded to the lower surface of a board.

Technical Solution

A lighting device according to an embodiment includes a light-emitting module including a board, at least one light-emitting element disposed in a first region of the board and a drive element disposed in a second region of the board so as to drive the at least one light-emitting element, a heat dissipation member disposed under a lower surface of the board, and a heat dissipation pad disposed between the board and the heat dissipation member, wherein the heat dissipation pad includes a heat dissipation plate disposed on an upper surface of the heat dissipation member, and a projecting portion projecting from an upper surface of the heat dissipation plate so as to support a lower surface of the first region of the board, and wherein the lower surface of the board is spaced apart from the heat dissipation plate.

The drive element may be bonded to the lower surface of the board, and a portion of the drive element that is bonded to the lower surface of the board may be spaced apart from the upper surface of the heat dissipation plate.

The board may be a double-sided printed circuit board that is provided on upper and lower surfaces thereof with respective circuit patterns.

The heat dissipation pad may include support protrusions, which are disposed on the upper surface of the heat dissipation plate in a state of being spaced apart from the projecting portion so as to support a peripheral portion of the board.

Each of the support protrusions may include a shoulder for supporting the peripheral portion of the board.

Each of the support protrusions may include an upper surface, and a stepped portion, which is a flat surface having a difference in height with respect to the upper surface, so as to support the peripheral portion of the board.

The heat dissipation pad may include first through holes, each of which is formed through a corresponding one of the support protrusions and the heat dissipation plate.

Each of the support protrusions may include a stepped surface disposed between the upper surface and the stepped portion, and each of the first through holes may be formed in a boundary surface between the stepped surface and the stepped portion.

The board may be provided in a peripheral edge thereof with second semicircular through holes corresponding to the first through holes.

The lighting device may further include first coupling members, each of which penetrates a corresponding one of the first through holes and a corresponding one of the second through holes so as to couple the board to the heat dissipation plate.

The board may include third through holes formed in the first region thereof, the projecting portion of the heat dissipation pad may include coupling holes corresponding to the third through holes, and the lighting device may further include second coupling members, which are fastened in the coupling holes through the third through holes.

A height of the stepped portion from the upper surface of the heat dissipation plate may be the same as a height of the projecting portion.

The lighting device may further include an insulation sheet disposed between the board and the heat dissipation pad. The insulation sheet may include an opening corresponding to the first region of the board and may be disposed between the second region of the board and the heat dissipation plate, and the projecting portion may be brought into contact with the lower surface of the first region of the board through the opening in the insulation sheet.

Advantageous Effects

Embodiments are capable of preventing shortening of life of drive elements attributable to heat generated from heat-emitting elements and of preventing electrical short between drive elements bonded to the lower surface of a board.

BEST MODE

Hereinafter, embodiments will be clearly revealed via description thereof with reference to the accompanying drawings. In the following description of the embodiments, it will be understood that, when an element such as a layer (film), region, pattern, or structure is referred to as being "on" or "under" another element, it can be directly on or under the other element or can be indirectly disposed such that an intervening element may also be present. In addition, it will also be understood that the criteria for "on" or "under" are determined on the basis of the drawings. The same reference numbers will be used throughout the drawings to refer to the same or like parts.

Figure 1:
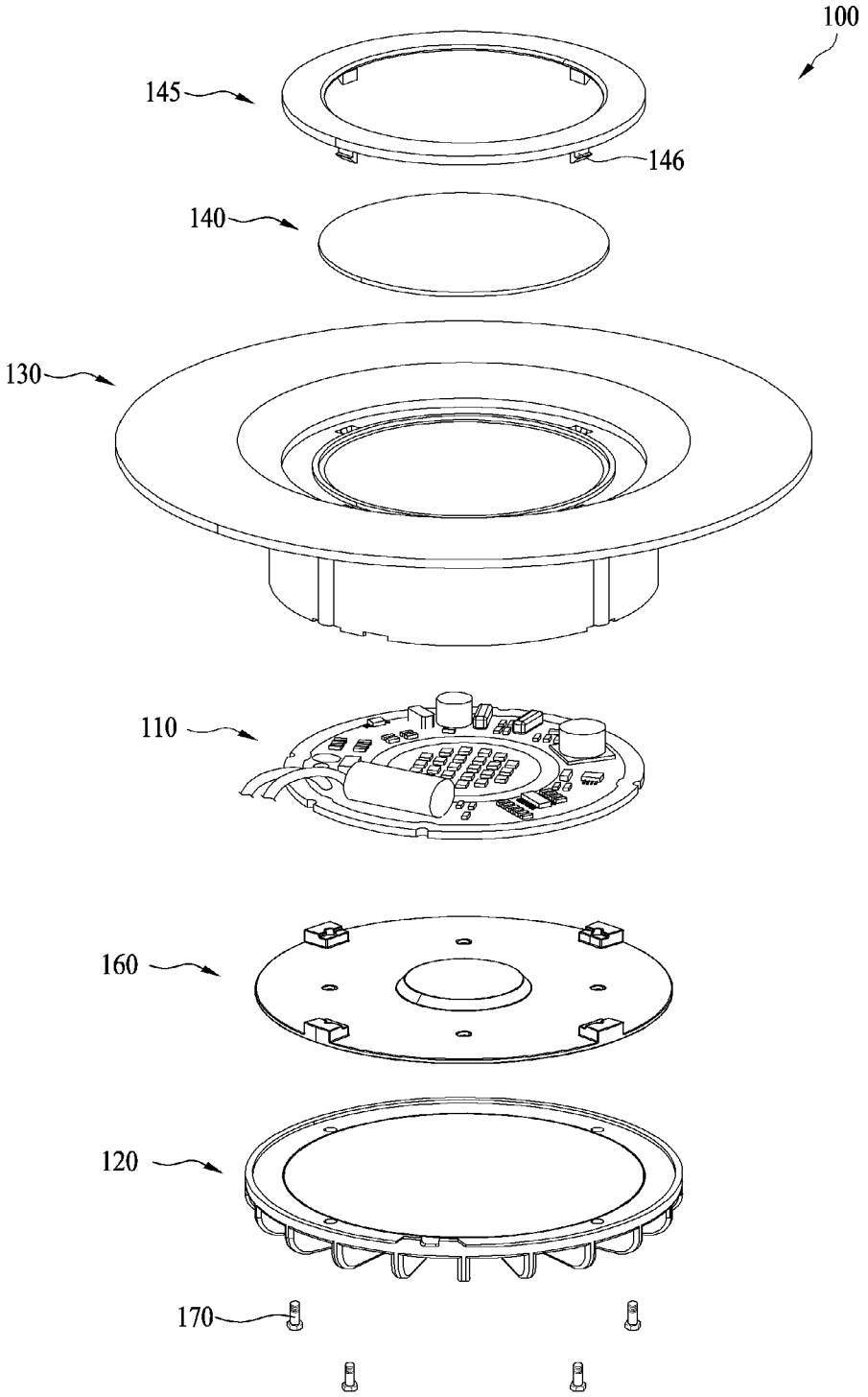
FIG. 1 is an exploded perspective view illustrating a lighting device according to an embodiment.
Figure 2:
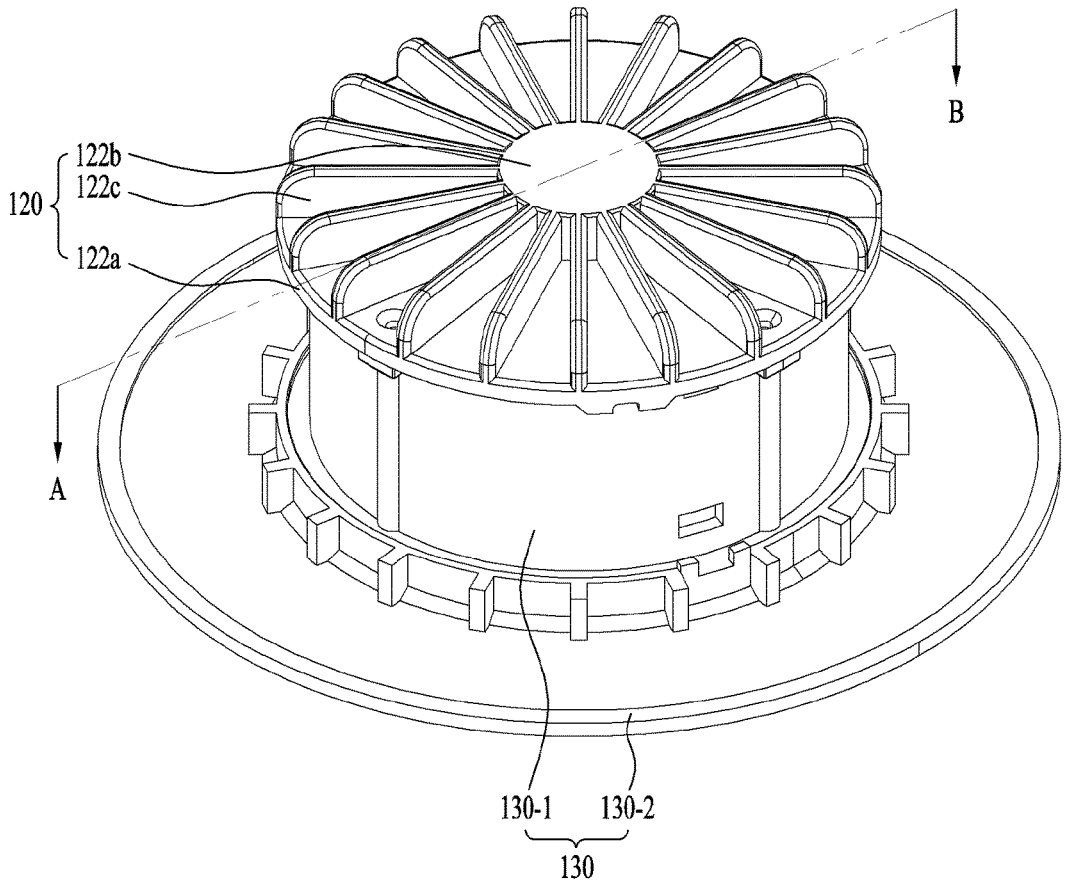
FIG. 2 is a first assembled perspective view of the lighting device shown in FIG. 1.
Figure 3:
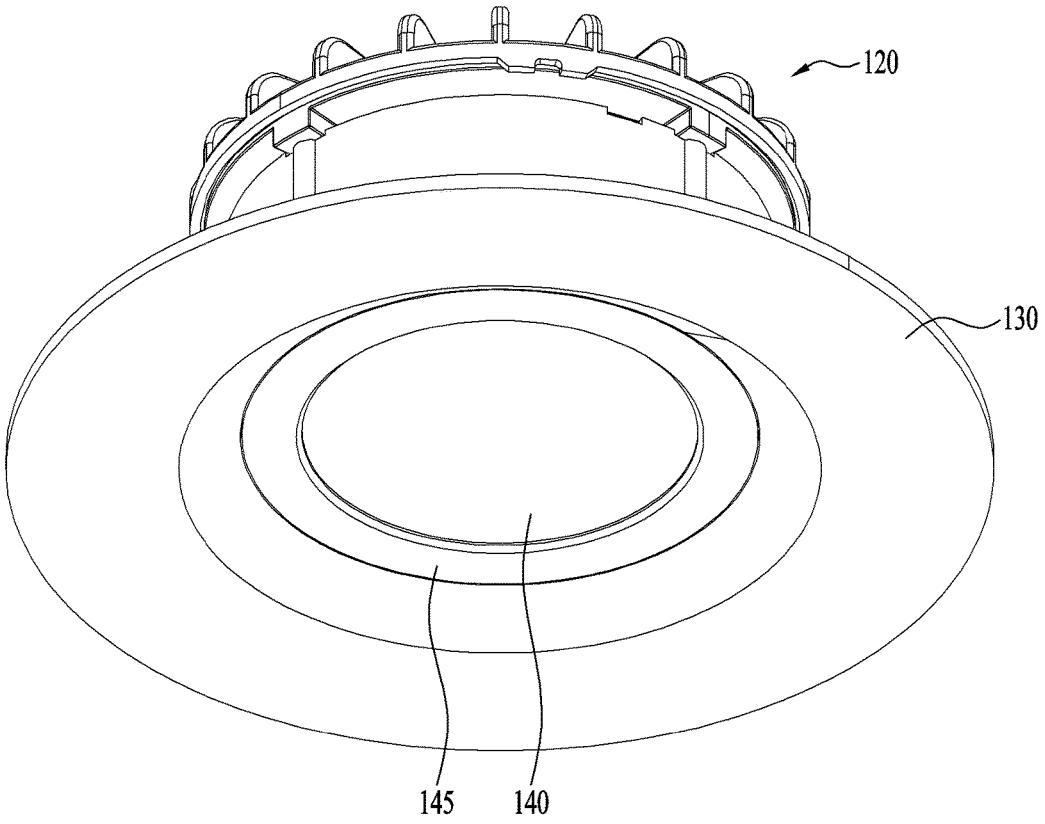
FIG. 3 is a second assembled perspective view of the lighting device shown in FIG. 1.
Figure 4:
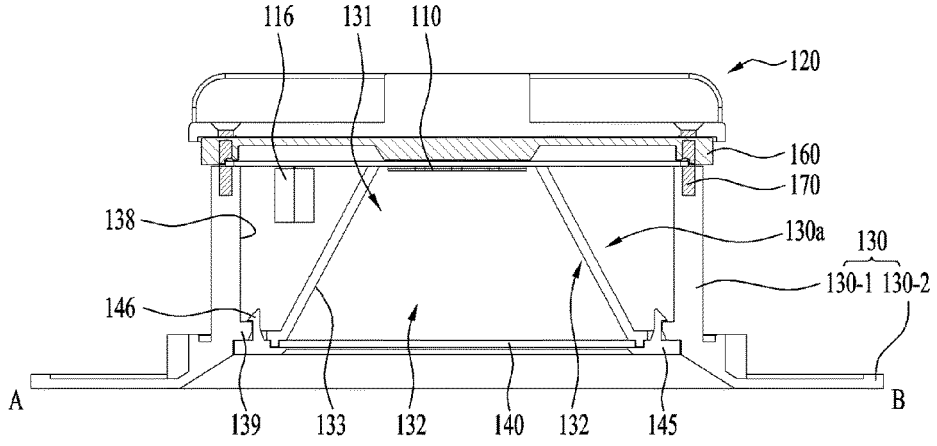
FIG. 4 is a cross-sectional view taken along line A-B of the lighting device shown in FIG. 2.

FIG. 1 is an exploded perspective view illustrating a lighting device 100 according to an embodiment, and FIG. 2 is a first assembled perspective view of the lighting device 100 shown in FIG. 1. FIG. 3 is a second assembled perspective view of the lighting device 100 shown in FIG. 1, and FIG. 4 is a cross-sectional view taken along line A-B of the lighting device 100 shown in FIG. 2.

Referring to FIGS. 1 to 4, the lighting device 100 includes a light-emitting module 110, a heat dissipation module 120, a housing 130, a diffusion plate 140, a heat dissipation pad 160 and coupling members 170.

The light-emitting module 110 generates light.

Figure 5A:
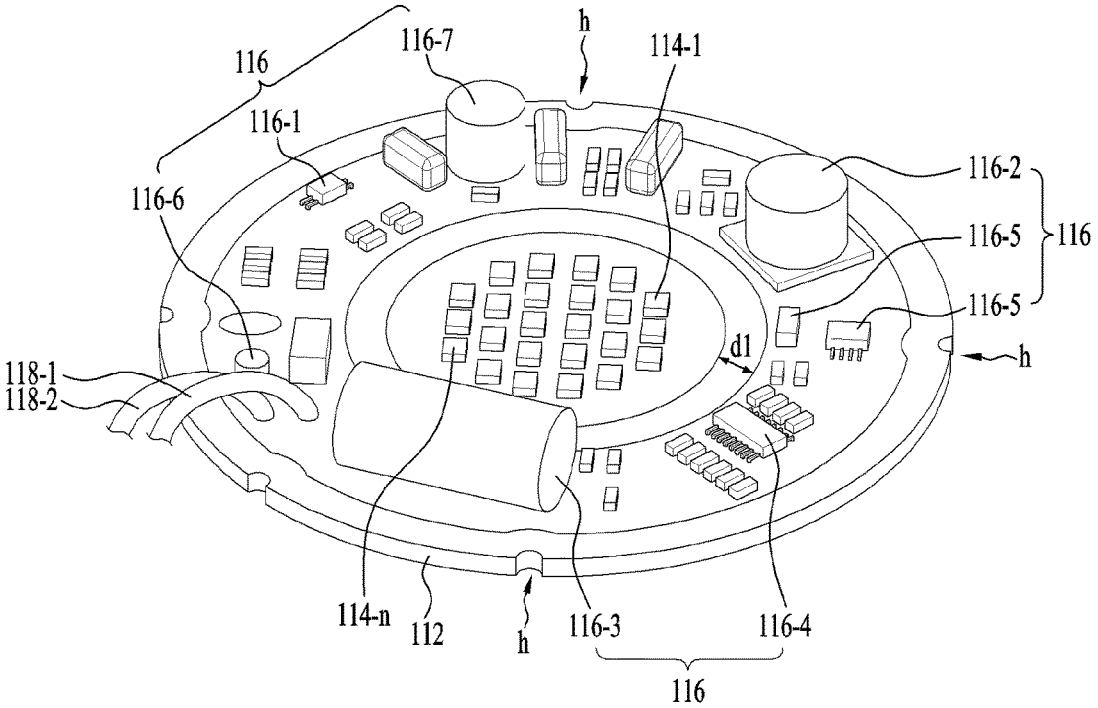
FIG. 5*a* is a perspective view of an example of the light-emitting module shown in FIG. 1.

FIG. 5*a* is a perspective view of an example of the light-emitting module 110 shown in FIG. 1.

Referring to FIG. 5*a*, the light-emitting module 110 may include a board 112, at least one light-emitting element 114 (114-1 to 114-*n*, n being a natural number greater than 1), and a drive element 116.

The board 112 may be made of a silicon material, a synthetic resin material or a metal material.

For example, the board 112 may include a conductive material, such as Al, which has a good heat-dissipating property. In order to prevent an electrical short between the at least one light-emitting element 114 and the drive element 116, the board 112 may be coated thereon with an insulation layer (not shown).

Furthermore, the board 112 may include a printed circuit board capable of electrically connecting the at least one light-emitting element 114 to the drive element 116. For example, the board 112 may be a printed circuit board, which includes an FR4 or a CEM-1 PCB.

For example, the board 112 may be a double-sided printed circuit board, each of upper and lower surfaces of which is provided with a circuit pattern or a wiring pattern.

The board 112 may be provided in a peripheral region thereof with through holes h through which the coupling members 170 pass. For example, each of the through holes h may be configured to be recessed from the peripheral edge and to have a semicircular shape.

By forming the through holes h in the peripheral edge of the board 112, it is possible to reduce the surface area that is occupied by the through holes h and to thus reduce the required surface area of the board 112. In addition, since it is possible to increase the surface area on which the light-emitting element and the drive element are disposed under conditions in which the surface area of the board 112 is fixed or constant, it is possible to increase a degree of freedom in disposition of the light-emitting element and the drive element.

The at least one light-emitting element 114 and the drive element 116 are disposed on the upper surface of the board 112. For example, the at least one light-emitting element 114 may be bonded or soldered to the upper surface 112-1 of the board 112.

At least one of elements constituting the drive element 116 may be mounted on the board 112 in such a way that the element penetrates the board 112 and is bonded or soldered to the lower surface of the board 112. The element may have legs required for bonding. Here, the legs of the drive element 116 may be pads, connection terminals or conductive lines, which are electrically connected to the circuit pattern or the wiring pattern formed on the lower surface of the board 112.

For example, in this embodiment, the light-emitting element 114 may include a plurality of light-emitting elements.

Each of the plurality of light-emitting elements 114-1 to 114-*n* (n being a natural number greater than 1) may be a light-emitting diode adapted to generate light, and may be of a chip type or a package type.

Figure 5B:
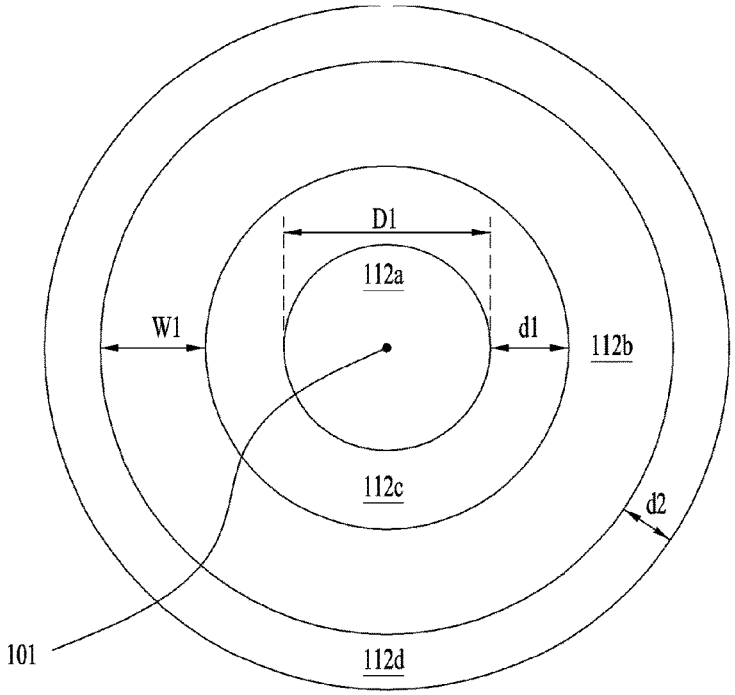
FIG. 5*b* illustrates regions constituting the board shown in FIG. 5*a;*

FIG. 5*b* illustrates regions constituting the board 112 shown in FIG. 5*a*.

Referring to FIG. 5*b*, the board 112 may include a first region 112*a* in which the light-emitting elements 114-1 to 114-*n* (n being a natural number greater than 1) are disposed, a second region 112*b* in which the drive element 116 is disposed, a third region positioned between the first region 112*a* and the second region 112*b*, and a fourth region positioned between the second region 112*b* and the peripheral edge of the board 112.

The light-emitting elements 114-1 to 114-*n* (n being a natural number greater than 1) may be disposed on the upper surface of the first region 112*a* of the board 112, and the drive element 116 may be disposed on the upper surface of the second region 112*b* of the board 112.

The first region 112*a* of the board 112 may include the center 101 of the board 112, and may be a central region within a predetermined range about the center 101 of the board 112. For example, the first region 112*a* of the board 112 may have a circular shape, an elliptical shape or a polygonal shape, without being limited thereto.

The second region 112*b* of the board 112 may be a region that is spaced apart from the first region 112*a* of the board 112 by a first distance d1 and from the peripheral edge of the board 112 by a second distance d2. For example, the second region 112*b* of the board 112 may have a ring shape or an annular strip shape, without being limited thereto.

The third region 112*c* of the board 112 may be a region that is positioned between the first region 112*a* and the second region 112*b*. For example, the third region 112*c* of the board 112 may have a ring shape or an annular strip shape, without being limited thereto.

The fourth region 112*d* of the board 112 may be a region that is positioned between the peripheral edge of the board 112 and the second region 112*b*. For example, the fourth region 112*d* of the board 112 may include the peripheral edge of the board 112.

The surface area of the first region 112*a* of the board 112 may be determined in proportion to the number of light-emitting elements 114-1 to 114-*n* (n being a natural number greater than 1). For example, the diameter D1 of the first region 112*a* of the board 112 may be in a range of 25 mm to 35 mm. Furthermore, the diameter D1 of the first region 112*a* of the board 112 may be 30 mm. In another embodiment, the diameter D1 of the first region 112*a* of the board 112 may be in a range of 20 mm to 30 mm. In a further embodiment, the diameter D1 of the first region 112*a* of the board 112 may also be in a range of 35 mm to 50 mm.

The surface area of the second region 112*b* of the board 112 may be determined in proportion to the number of drive elements 116 so as to ensure easy electrical wiring between the drive elements. For example, the width W1 of the second region 112*b* of the board 112 may be in a range of 15 mm to 20 mm. In an example, the width W1 of the second region 112*b* of the board 112 may be 17.5 mm. The width W1 of the second region 112*b* of the board 112 may be a fixed value, without being limited thereto.

In order to suppress the transfer of heat generated from the light-emitting elements 114-1 to 114-*n* (n being a natural number greater than 1) to the drive element and to reduce the size of the board 112, the diameter D1 of the first region 112*a* of the board 112 may be greater than the width W1 of the second region 112*b* of the board 112 (D1>W1).

In order to suppress the transfer of heat generated from the light-emitting elements 114-1 to 114-*n* (n being a natural number greater than 1) to the drive element and to reduce the size of the board 112, the first distance d1 may be greater than the second distance (d1>d2).

The first distance d1 may be in a range of 10 mm to 15 mm. For example, the first distance d1 may be 12 mm.

The second distance d1 may be in a range of 3 mm to 7 mm. For example, the second distance d2 may be 5 mm.

The plurality of light-emitting elements 114-1 to 114-*n* (n being a natural number greater than 1) may be disposed in the first region 112*a* of the board 112 while being spaced apart from each other.

For example, the plurality of light-emitting elements 114-1 to 114-*n* (n being a natural number greater than 1) may be disposed on the upper surface 112-1 of the first region 112*a* of the board 112 while being spaced apart from each other, and may be bonded or soldered to the upper surface 112-1 of the first region 112*a* of the board 112.

The light-emitting elements 114-1 to 114-*n* (n being a natural number greater than 1) may be electrically connected to each other in series, without being limited thereto. In another embodiment, the light-emitting elements 114-1 to 114-*n* (n being a natural number greater than 1) may also be connected to each other in parallel or in series-parallel.

The drive element 116 may drive the light-emitting elements 114-1 to 114-*n* (n being a natural number greater than 1) using AC power. For example, the drive element 116 may convert the AC power into DC power through rectification of the AC power and may supply the converted DC power to the light-emitting elements 114-1 to 114-*n* (n being a natural number greater than 1).

For example, the drive element 116 may include a power supply unit for supplying DC power to the light-emitting elements 114-1 to 114-*n* (n being a natural number greater than 1).

For example, the drive element 116 may include a bridge diode 116-1, a voltage converter 116-2, a condenser 116-3, a driver IC 116-4, a diode 116-5, a first inductor 116-6, a second inductor 116-7, an FET transistor 116-8 and the like.

The bridge diode 116-1 rectifies AC power.

The condenser 116-3 and the inductors 116-6 and 116-7 may constitute a smoothing circuit, and may convert the rectified AC power into DC power.

The voltage converter 116-2 converts the voltage of the DC power so as to be suitable for operation of the light-emitting elements 114-1 to 114-*n* (n being a natural number greater than 1).

The driver IC 116-4 may control the operation of the light-emitting elements 114-1 to 114-*n* (n being a natural number greater than 1).

The diode 116-5 may be a Zener diode, without being limited thereto. For example, the diode 116-5 may protect the light-emitting elements 114-1 to 114-*n* (n being a natural number greater than 1) and the drive element 116 from surges introduced from the outside.

Figure 5C:
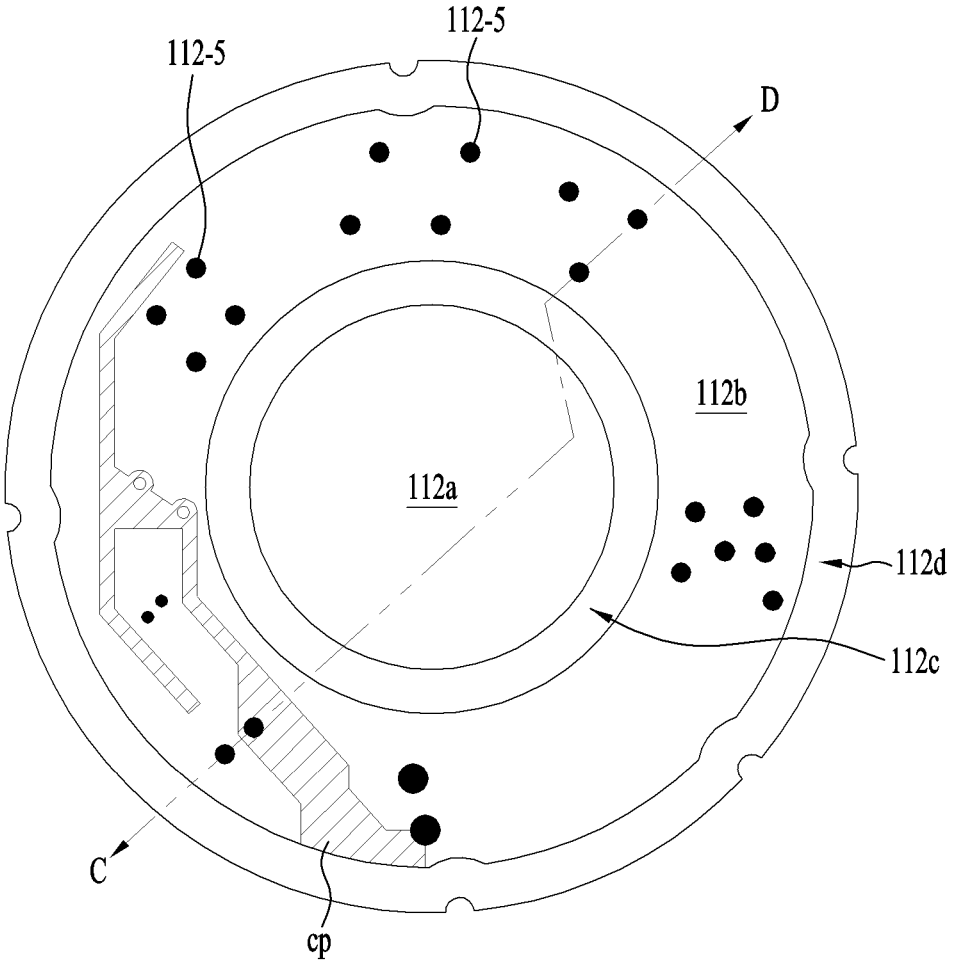
FIG. 5*c* is a bottom view of the light-emitting module shown in FIG. 5*b;*
Figure 5D:
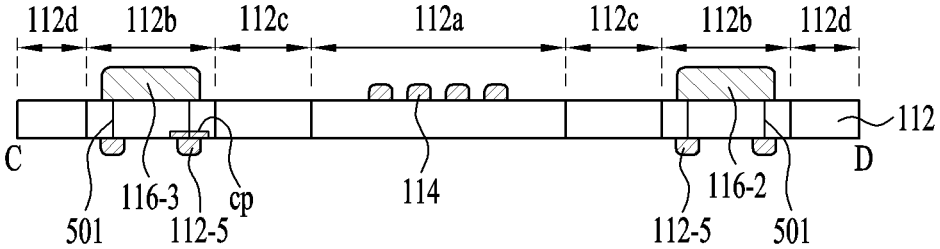
FIG. 5*d* is a cross-sectional view taken along line CD of the board shown in FIG. 5*c;*

FIG. 5*c* is a bottom view of the light-emitting module 110 shown in FIG. 5*b*, and FIG. 5*d* is a cross-sectional view taken along line CD of the board 112 shown in FIG. 5*c*.

Referring to FIGS. 5*c* and 5*d*, the first region 112*a* of the board 112 may be provided on the upper surface thereof with a first circuit pattern or a first wiring pattern (not shown) to which the light-emitting elements 114-1 to 114-2 are electrically connected. Furthermore, the second region 112*b* of the board 112 may be provided on the upper surface thereof with a second circuit pattern or a second wiring pattern (not shown) to which one of the elements 116-1 to 116-8 of the drive element 116 is electrically connected.

For example, the second region 112*b* of the board 112 may also be provided on the lower surface thereof with a third circuit pattern or a third wiring pattern CP to which another of the elements of the drive element 116 is electrically connected.

The legs of at least one (for example, the voltage converter 116-2 and the condenser 116-3) of the elements 116-1 to 116-8 included in the drive element 116 may penetrate the second region 112*b* of the board 112, and the legs 501, which have penetrated the second region 112*b* of the board 112, may be bonded or soldered to the lower surface 112-2 of the second region 112*b* of the board 112. Consequently, the second region 112*b* of the double-sided printed circuit board 112 may be provided on the lower surface thereof with soldered portions 112-5, which are bonded to the legs 501 of at least one (for example, the voltage converter 116-2 and the condenser 116-3) of the elements 116-1 to 116-8 included in the drive element 116. Each of the soldered portions 112-5 may have a protrusion shape, which projects from the lower surface of the second region 112*b* of the board 112. The soldered portions 112-5 may be electrically connected to the third circuit pattern CP of the board 112.

Since the light-emitting elements 114-1 to 114-*n* (n being a natural number greater than 1) are bonded to the upper surface of the first region 112*a* of the board 112, there is no soldered portion on the lower surface of the first region 112*a* of the board 112.

The heat dissipation member 120 is disposed under the lower surface of the board 112 of the light-emitting module 110 so as to dissipate heat generated from the light-emitting elements 114-1 to **114-*n* (n being a natural number greater than 1). The heat dissipation member 120** may also be referred to as a heat sink.

Figure 6:
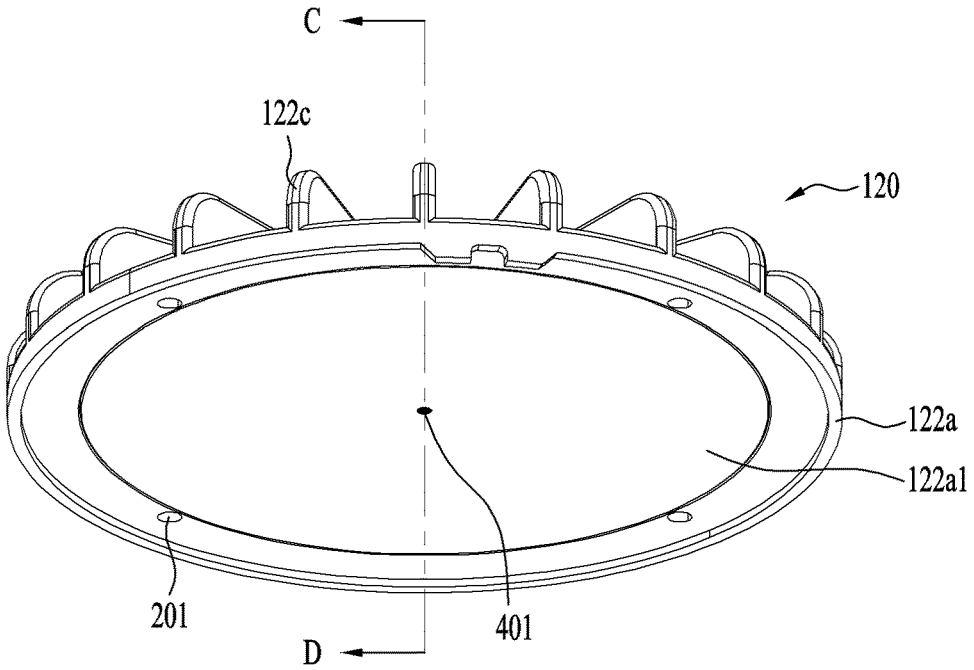
FIG. 6 is a first perspective view of the heat dissipation member shown in FIG. 1.
Figure 7:
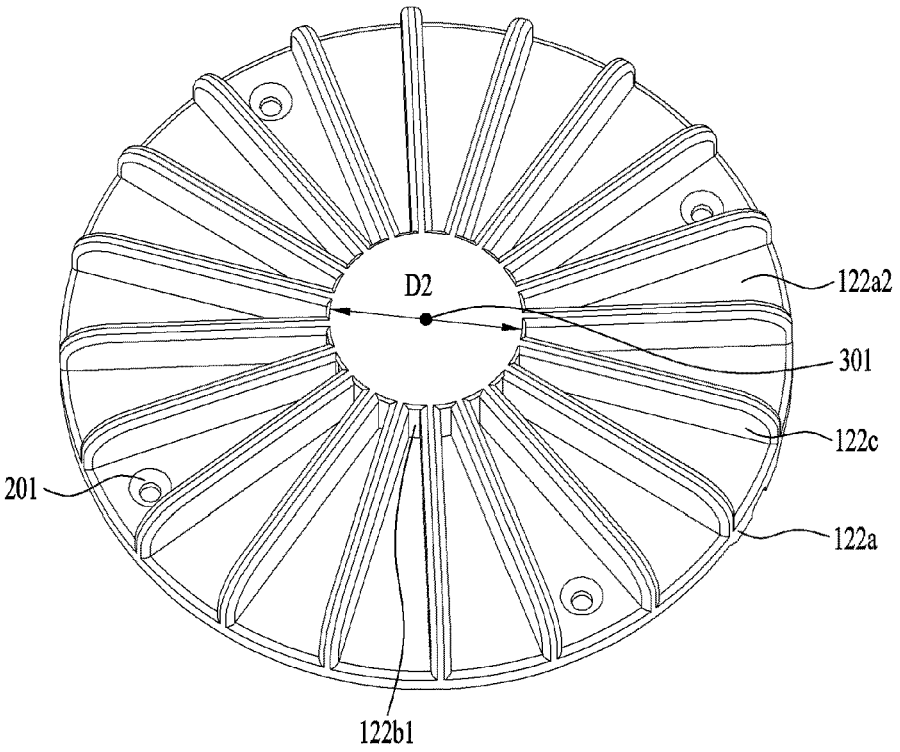
FIG. 7 is a second perspective view of the heat dissipation member shown in FIG. 1.
Figure 8:
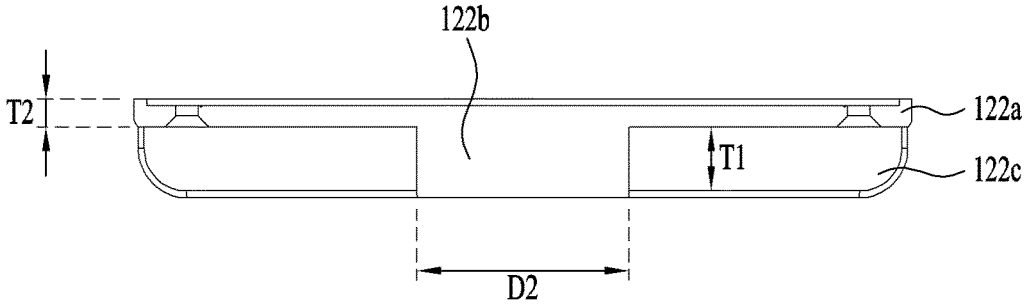
FIG. 8 is a cross-sectional view taken along line CD of the heat dissipation member shown in FIG. 6.

FIG. 6 is a first perspective view of the heat dissipation member 120 shown in FIG. 1, FIG. 7 is a second perspective view of the heat dissipation member 120 shown in FIG. 1, and FIG. 8 is a cross-sectional view taken along line CD of the heat dissipation member 120 shown in FIG. 6.

Referring to FIGS. 6 to 8, the heat dissipation member 120 may include a base **122*a*, a core 122*b* and heat dissipation fins 122*c***.

The base **122*a* may be configured to have a plate shape corresponding to the board 112, and may be made of a metal material having good heat conductivity, such as aluminum (Al). For example, the base 122*a* may have a shape coinciding with the shape of the board 112, and may have a uniform thickness. The base 122*a*** may be made of a single plate or a composite body in which two or more plates are stacked.

The front surface **122*a*1 of the base 122*a* may be positioned so as to face the lower surface of the board 112. The board 112 of the light-emitting module 110 may be disposed on the front surface 122*a*1 of the base 122*a*. The base 122*a* may have through holes 201 into which the coupling members 170 are fastened so as to couple the base 122*a* to the housing 130**.

The core **122*b* is connected to the lower surface 122*a*2 of the base 122*a*, and is positioned so as to correspond to or to be aligned with the first region 112*a* of the board 112. The reason for this is to directly dissipate heat, which is generated from the light-emitting elements 114-1 to 114-*n* (n being a natural number greater than 1) positioned in the first region 112*a*, through the core 122*b***.

The core **122*b* may have a protrusion shape, which projects from the lower surface 122*a*2 of the base 122*a***.

For example, the center 301 of the core **122*b* may be aligned with the center 401 of the base 122*a*. Furthermore, the center 301 of the core 122*b* may, for example, be aligned with the center 101 of the first region 112*a* of the board 112**.

The heat dissipation fins **122*c* may be connected both to the lateral surface 122*b*1 of the core 122*b* and to the lower surface 122*a*2 of the base 122*a* so as to dissipate heat transferred from the core 122*b***.

For example, each of the heat dissipation fins **122*c* may have a plate shape, and the heat dissipation fins 122*c* may include a plurality of fins, which are spaced apart from one another so as to be radially arranged about the core 122*b*. Each of the plurality of heat dissipation fins 122*c* may be connected at one end thereof to the lateral surface 122*b*1 of the core 122*b* and at the other end thereof to the peripheral edge of the lower surface 122*a*2 of the base 122*a***.

As shown in FIG. 8, in order to improve the efficiency of heat dissipation, the thickness T1 of the core **122*b* is greater than the thickness T2 of the base 122*a* (T1>T2). Since the core 112*b* is aligned with the first region 112*a* of the board 112, at which the light-emitting elements 114-1 to 114-*n* (n being a natural number greater than 1) are positioned, and the thickness T1 of the core 122*b* is greater than the thickness T2 of the base 112*a*, heat generated from the light-emitting elements 114-1 to 114-*n* (n being a natural number greater than 1) is efficiently transferred to the heat dissipation fins 122*c* through the core 122*b***, thereby improving the efficiency of heat dissipation.

The heat dissipation pad 160 is disposed between the board 112 of the light-emitting module 110 and the heat dissipation member 120. For example, the heat dissipation pad 160 may be disposed between the lower surface 112-2 of the board 112 of the light-emitting module 110 and the upper surface **122*a*1 of the base 122*a* of the heat dissipation member 120**.

The heat dissipation pad 160 may be made of a metal material, such as aluminum (Al), copper (Cu), silver (Ag) or the like, which has good heat conductivity so as to promote heat transfer to the heat dissipation member 120 from the light-emitting element 114.

Figure 9:
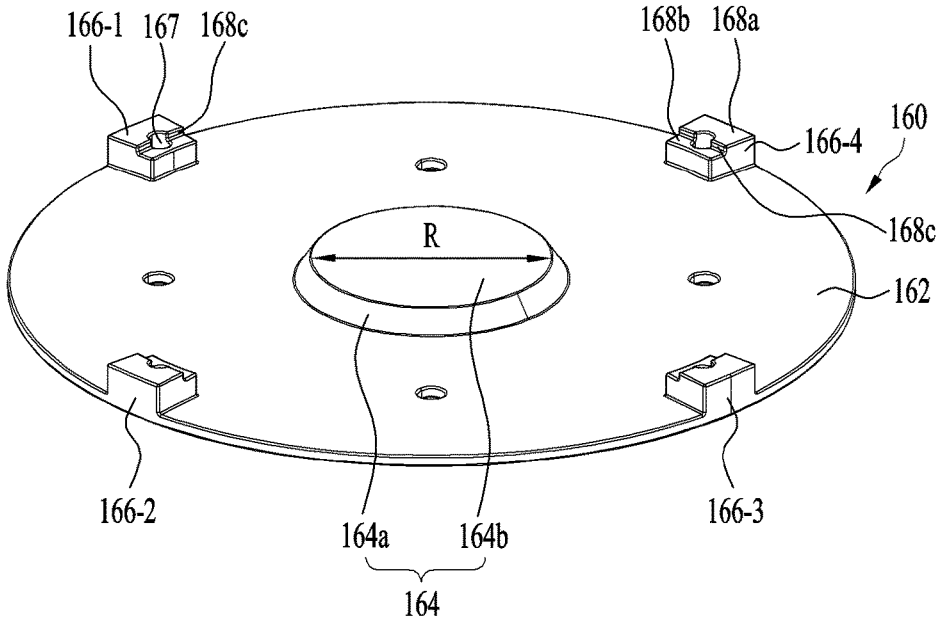
FIG. 9 illustrates the heat dissipation pad shown in FIG. 1.
Figure 10:
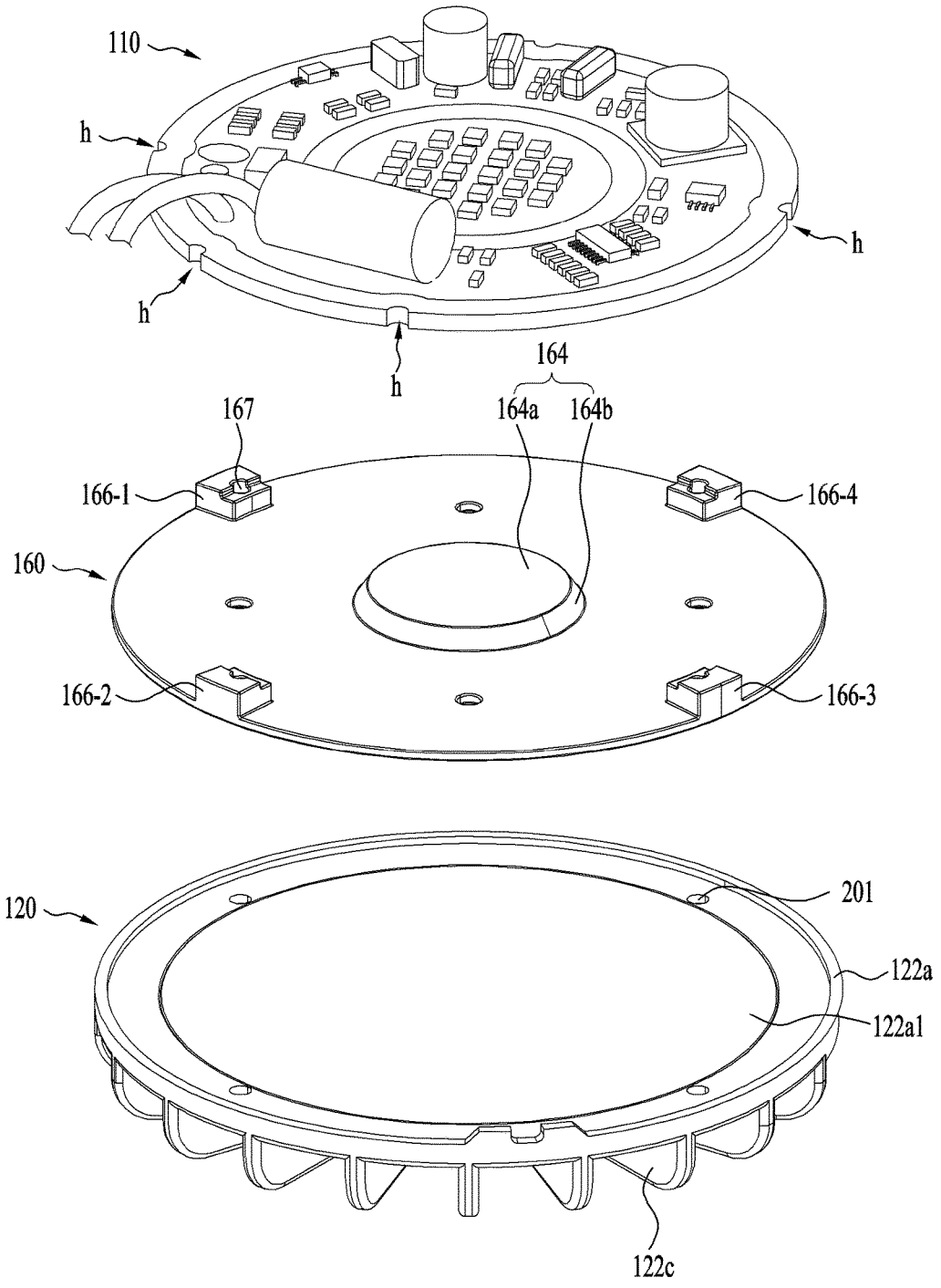
FIG. 10 is an exploded perspective view of the light-emitting module, the heat dissipation pad and the heat dissipation member, which are shown in FIG. 1.
Figure 11:
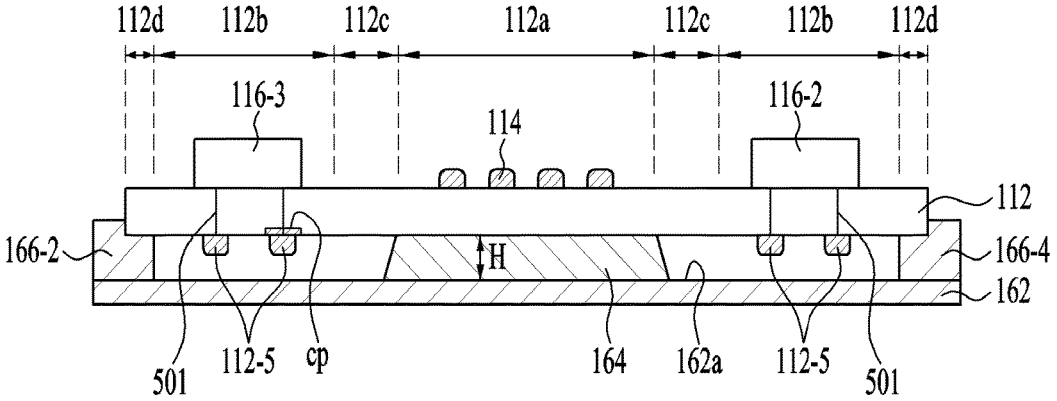
FIG. 11 is an assembled cross-sectional view of the light-emitting module and the heat dissipation plate, which are shown in FIG. 1.

FIG. 9 illustrates the heat dissipation pad 160 shown in FIG. 1, FIG. 10 is an exploded perspective view of the light-emitting module 110, the heat dissipation pad 160 and the heat dissipation member 120, which are shown in FIG. 1, and FIG. 11 is an assembled cross-sectional view of the light-emitting module 110 and the heat dissipation plate 160, which are shown in FIG. 1.

Referring to FIGS. 9 to 11, the heat dissipation pad 160 includes a heat dissipation plate 162, a projecting portion 164 projecting from the upper surface of the heat dissipation plate 162, and support protrusions 166-1 to 166-4 disposed on the upper surface **162*a* of the heat dissipation plate 162**.

The heat dissipation plate 162 may be a flat plate, for example, a circular flat plate, having a shape that coincides with or is identical to that of the board 112 or the base **122*a* of the heat dissipation member 120. The lower surface of the heat dissipation plate 162 may be brought into contact with the upper surface of the base 122*a* of the heat dissipation member 120**.

The projecting portion 164 may be positioned at the central area of the upper surface **162*a* of the heat dissipation plate 162, which corresponds to or is aligned with the first region 112*a* of the board 112 and the core 122*b* of the heat dissipation member 120. For example, the center of the projecting portion 164 may be aligned with the center of the first region 112*a* of the board 112 in a vertical direction, without being limited thereto. Furthermore, the center of the projecting portion 164 may be aligned with the center of the core 122*b* of the heat dissipation member 120** in a vertical direction, without being limited thereto.

The lateral surface **164*a* of the projecting portion 164 may be a sloping surface, which is inclined at a predetermined angle with respect to the upper surface 162*a* of the heat dissipation plate 162**.

The upper surface **164*b* of the projecting portion 164 may be flat, and may be brought into contact with the lower surface of the first region 112*a* of the board 112**.

The upper surface **164*b* of the projecting portion 164 may be a flat surface having a shape, such as a circular shape, an elliptical shape or a polygonal shape, which coincides with or is identical to the shape of the first region 112*a* of the board 112. Here, the upper surface 164*b* of the projecting portion 164 may be the surface that faces the lower surface of the board 112**.

For example, the diameter R of the projecting portion 164 may gradually increase toward the lower surface from the upper surface of the projecting portion 164. When the diameter of the projecting portion 164 gradually increases toward the lower surface from the upper surface of the projecting portion 164, heat transfer to the core **122*b* of the heat dissipation member 120 from the light-emitting module 110 may be improved. Consequently, the embodiment may suppress an increase in the temperature of the drive element 116 and may thus protect the drive element 116 upon light emission of the light-emitting elements 114-1 to 114-*n***.

The diameter (or surface area) of the upper surface 164*b* of the projecting portion 164 may be equal to or smaller than the diameter (or surface area) of the first region 112*a* of the board 112, without being limited thereto. In another embodiment, in order to improve heat transfer, the diameter (or surface area) of the upper surface 164*b* of the projecting portion 164 may be larger than the diameter (or surface area) of the first region 112*a* of the board 112.

The lower surface of the projecting portion 164 may have a shape that coincides with or is identical to the shape of the core 122*b* of the heat dissipation member 120. The diameter (or surface area) of the lower surface of the projecting portion 164 may be equal to or smaller than the diameter (or surface area) of the core 122*b* of the heat dissipation member 120, without being limited thereto. In another embodiment, in order to improve heat transfer, the diameter (or surface area) of the lower surface of the projecting portion 164 may be larger than the diameter (or surface area) of the core 122*b* of the heat dissipation member 120.

The projecting portion 164 functions to suppress heat transfer to the drive element 116 disposed in the second region 112*b* of the board 112 by rapidly transferring heat generated from the light-emitting elements 114-1 to 114-*n*, disposed in the first region 112*a*, to the core 122*b* of the heat dissipation member 120.

Since the upper surface 164*b* of the projecting portion 164 is brought into contact with the lower surface of the first region 112*a* of the board 112 and the projecting portion 164 supports the first region 112*a* of the board 112, the board 112 may be positioned so as to be spaced apart from the heat dissipation plate 162 of the heat dissipation pad 160.

In other words, the first region 112*a* and second region 112*b* of the board 112 may be positioned so as to be spaced apart from the upper surface 162*a* of the heat dissipation plate 162 by means of the projecting portion 164. Furthermore, the soldered portions 112-5 formed on the lower surface of the second region 112*b* of the board 112 may be spaced apart from the upper surface 162*a* of the heat dissipation plate 162 by means of the projecting portion 164.

For example, the soldered portions 112-5 may be disposed in a space defined between the projecting portion 164 and the support protrusions 166-1 to 166-4.

In order to space the soldered portions 112-5 apart from the upper surface 162*a* of the heat dissipation plate 162, the height H of the projecting portion 164 may be set to be 2.5 mm to 5 mm. If the height of the projecting portion 164 is less than 2.5 mm, it is impossible to ensure a reliable space between the soldered portions 112-5 and the upper surface 162*a* of the heat dissipation plate 162. On the other hand, if the height of the projecting portion 164 is greater than 5 mm, the distance between the board 112 and the heat dissipation member 120 is excessively increased, thereby lowering the efficiency of heat dissipation. For example, in another embodiment, the height H of the projecting portion 164 may be in a range of 3 mm to 3.5 mm.

The support protrusions 166-1 to 166-4 may be disposed on the upper surface 162*a* of the heat dissipation plate 160 so as to be spaced apart both from each other and from the projecting portion 164, and may support the peripheral portion of the board 112.

Each of the support protrusions 166-1 to 166-4 may include a shoulder for supporting the peripheral portion of the board 112. For example, each of the support protrusions 166-1 to 166-4 may include an upper surface 168*a*, and a stepped portion 168*b*, which is a flat surface having a difference in height with respect to the upper surface in a vertical direction. For example, the stepped portion 168*b* may be parallel to the upper surfaces of the support protrusions 166-1 to 166-4.

In order to stably support the board 112, the height of the stepped portion 168*b* from the upper surface of the heat dissipation plate 162 may be the same as the height H of the upper surface of the projecting portion 164.

The stepped portions 168*b* of the support protrusions 166-1 to 166-4 may be positioned so as to face the projecting portion 164, without being limited thereto. A stepped surface 168*c* may be present between each of the stepped portions 168*b* and each of the upper surfaces 168*a*.

The peripheral portion of the board 112 may be supported by the stepped portions 168*b* of the support protrusions 166-1 to 166-4. For example, the stepped portion 168*b* of each of the support protrusions 166-1 to 166-4 may be brought into contact with the lower surface of the fourth region 112*d* of the board 112 so as to support the fourth region 112*d* of the board 112.

Since the lower surface of the fourth region 112*d* of the board 112 is brought into contact with the stepped portions 168*b* of the support protrusions 166-1 to 166-4 and the edge of the board 112 is brought into contact with the stepped surfaces 168*c* of the support protrusions 166-1 to 166-4, the board 112 may be more stably supported.

The heat dissipation pad 160 may include through holes 167, each of which is formed through a corresponding one of the support protrusions 166-1 to 166-4 and the heat dissipation plate 162. For example, each of the through holes 167 may be formed in the boundary surface between the stepped surface 168*c* and the stepped portion of the support protrusion, without being limited thereto.

For example, each of the through holes 167 may be depressed into the stepped surface 168*c*, and may be formed throughout the stepped portion 168*b*, the stepped surface 168*c* and the upper surface 168*a*. The through holes h in the board 112 may be aligned with the stepped portions 168*b*. For example, each of the through holes h in the board 112, which has a semicircular shape, may be aligned with at least part of the through hole 167 formed in the stepped portions 168*b*.

The through holes h in the board 112, the through holes 167 in the heat dissipation pad 160 and the through holes 201 in the heat dissipation member 120 may be positioned so as to be aligned with one another in a vertical direction. The coupling members 170 may be coupled to the housing 130 through the through holes 201 in the heat dissipation member 120, the through holes 167 in the heat dissipation pad 160 and the through holes h in the board 112. For example, the coupling members 170 may be fastening elements such as screws or nails.

In the case in which the legs of the drive elements are soldered to the lower surface of the board, the lower surface of the board is typically provided with soldered portions each having a protrusion shape. The soldered portions may be brought into contact with the heat dissipation pad, which is made of a conductive metal material, and thus an electrical short may occur between the drive elements. In addition, since the flatness of the lower surface of the board is deteriorated due to the soldered portions, adhesive force between the board and the heat dissipation pad may be decreased, and the efficiency of heat dissipation may thus be lowered.

As shown in FIG. 11, since the heat dissipation pad 160 according to an embodiment includes the projecting portion 164, it is possible to improve efficiency of heat dissipation by rapidly transferring heat generated from the light-emitting elements 114-1 to **114-*n* to the core 122*b* of the heat dissipation member 120**.

In addition, since the soldered portions 112-5 are spaced apart from the heat dissipation plate 162 by means of the projecting portion 164, the embodiment is able to prevent the occurrence of an electrical short between the drive elements.

Figures 14, 15:
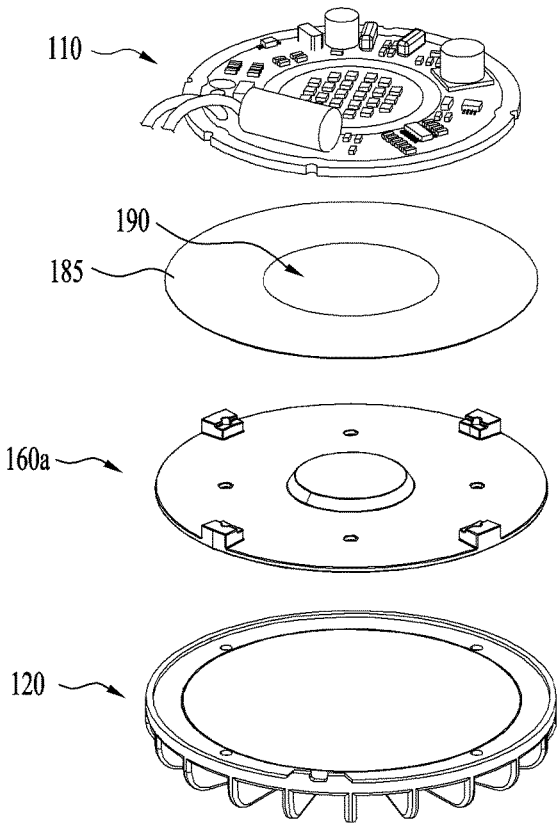
FIG. 14 illustrates an insulation sheet according to another embodiment.
FIG. 15 illustrates an experimental result that represents measured temperatures of the light-emitting elements and the drive elements of the lighting device according to the embodiment.

FIG. 15 illustrates an experimental result that represents measured the temperatures of the light-emitting elements and the drive elements 116 of the lighting device according to the embodiment. In FIG. 15, Ts1 denotes the surface temperature of one of light-emitting elements that are disposed at the center, and Ts2 denotes the surface temperature of another of the light-emitting elements that are disposed at the center. External air in FIG. 15 denotes the ambient temperature around the lighting device 100.

Referring to FIG. 15, except for the diode 116-5, the measured temperatures of the elements 116-2 to 116-4 and 116-6 to 116-8 of the drive element 116 are lower than the surface temperatures Ts1 and Ts2 of the light-emitting elements. In other words, since the temperature of the drive elements 116-2 to 116-4 and 116-6 to 116-8 is prevented from becoming higher than the surface temperatures of the light-emitting elements by means of the heat dissipation pad, it is possible to prevent degradation of the drive elements 116-2 to 116-4 and 116-6 to 116-8.

In addition, since the projecting portion 164 and the support protrusions 166-1 to 166-4 serve to space the soldered portions 112-5 formed on the lower surface of the second region **112*b* of the board 112 apart from the heat dissipation pad 160 so as to prevent contact between the soldered portions 112-5 and the heat dissipation pad 160**, it is possible to prevent the occurrence of an electrical short between the drive elements.

As shown in FIG. 2, the housing 130 may be coupled to the board 112, the heat dissipation pad 160 and the heat dissipation member 120 by means of the coupling members 170, and may include a first part 130-1 for accommodating the light-emitting module 110 and the heat dissipation pad 160, and a second part 130-1 connected to one end of the first part 130-1 and having an expansion portion expanding laterally and horizontally. The housing 130 may be made of a metal or plastic material. For example, the first part 130-1 of the housing 140 may be configured to have a cylindrical shape, and the second part 130-2 may be configured to have a plate shape. However, the first and second parts are not limited to the above shapes, and may be embodied to have various shapes.

Referring to FIG. 4, the first part 130-1 of the housing 130 may include a reflection portion **130*a*, which includes a first opening 131, a second opening 132, and a reflective surface 133 disposed between the first opening 131 and the second opening 132**.

The first opening 131 may be provided at one end of the reflective surface 133 so as to correspond to or to be aligned with the first region **112*a* of the board 112 and to expose the light-emitting elements 114-1 to 114-*n***.

The reflective surface 133 of the housing 130 may reflect light radiated from the light-emitting elements 114-1 to **114-*n*. The reflective surface 132 may be inclined with respect to the upper surface of the board 112 at a predetermined angle. The second opening 132 in the housing 130 may be provided at the other end of the reflective surface 133**.

For example, the diameter of the reflective surface 133 of the housing 130 may increase toward the second opening 132 from the first opening 131. For example, the reflective surface 133 of the housing 130 may be configured to have a truncated conical shape, without being limited thereto.

The drive element 116 may be disposed between the inner circumferential surface 138 of the housing 130 and the reflection portion **130*a*. Specifically, since the reflective surface 133 of the reflection portion 130*a* is positioned between the drive elements 116 and the light-emitting elements 114-1 to 114-*n* and the reflective surface 133 reflects light radiated from the light-emitting elements 114-1 to 114-*n*, the reflection portion 130*a* is able to impede the absorption of heat by the drive element 116 and to improve the luminescent efficiency of the lighting device 100**.

The diffusion plate 140 is disposed on the housing 140 so as to diffuse light radiated from the light-emitting elements 114-1 to **114-*n*. For example, the diffusion plate 140 may be disposed so as to cover the second opening 132 in the housing 130**.

The lighting device 100 may further include a diffusion plate holder 145 for holding the diffusion plate 140 to the housing 130. The diffusion plate holder 145 may include at least one support 146, which is adapted to be coupled to the housing 130. For example, the support 146 may include a plurality of supports, each of which is bent at the end thereof to have a barb or hook shape so as to be caught by a projecting flange 138 provided on the inner circumferential surface of the housing 130.

The ratio of the diameter D2 of the core **122*b* to the diameter D1 of the first region 112*a* may be in the range of 5/7 to 8/5. For example, D2/D1** may be in a range 5/6 to 4/3.

If D2/D1 is less than 5/6 or greater than 4/3, the lifespan of the condenser 116-3 may be shortened due to the increase in the temperature of the condenser.

The lifespan of the drive element 116 may be affected by the surface temperature of the drive element 116 and the difference between the surface temperature of the drive element 116 and the ambient temperature. When the surface temperature of the drive element 116 is high, the lifespan of the drive element 116 may be shortened. The embodiment is intended to radiate heat generated from the light-emitting elements 114-1 to **114-*n* through the heat dissipation member 120 and to suppress heat transfer to the drive elements 116 when light is emitted from the light-emitting elements 114-1 to 114-*n*. Consequently, it is possible to suppress an increase in temperature of the drive element 116, for example, the condenser 116-3, and to thus increase the lifespan of the drive element 116**.

Figure 12:
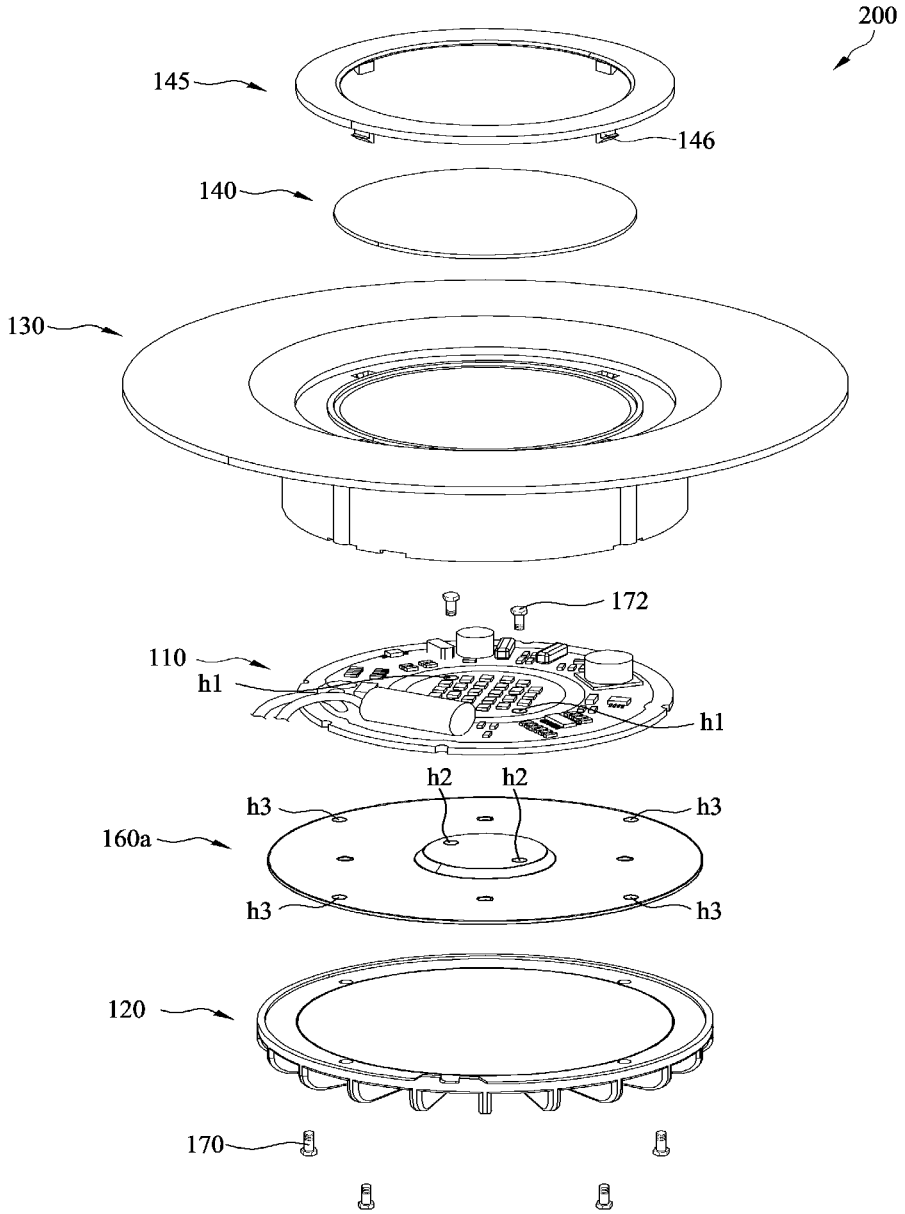
FIG. 12 is an exploded perspective view of a lighting device according to another embodiment.

FIG. 12 is an exploded perspective view of a lighting device 200 according to another embodiment. The same numerals as the numerals used in FIG. 1 denote the same components, and a description thereof is briefly given or omitted.

Referring to FIGS. 9 and 12, the heat dissipation pad **160*a* shown in FIG. 12 is identical to the heat dissipation pad 160 shown in FIG. 1, with the exception that the support protrusions 166-1 to 166-4 are omitted and through holes h3 are formed only through the heat dissipation plate 162, in place of the through holes 167**.

The upper surface **164*b* of the projecting portion 164 of the heat dissipation pad 160*a* shown in FIG. 12 is provided with coupling holes h2. Furthermore, the board 112 may be provided with through holes h1, which correspond to or are aligned with the coupling holes h2 formed in the projecting portion 164 of the heat dissipation pad 160. The through holes h1 may be formed through the board 112 and may be positioned in the first region 112*a***, without being limited thereto.

Coupling members 172 may be fastened into the coupling holes h2 formed in the projecting portion 164 through the through holes h1 in the board 112. For example, the coupling members 172 may be fasteners, such as screws or nails, and the coupling holes h2 may be provided with female threaded portions.

The heat dissipation pad 160*a* shown in FIG. 12 may exclude the support protrusions 166-1 to 166-4, and the board 112 and the projecting portion 164 of the heat dissipation pad 160 may be coupled to each other by means of the coupling members 172, thereby increasing the binding force between the board 112 and the heat dissipation pad 160.

Figure 13:
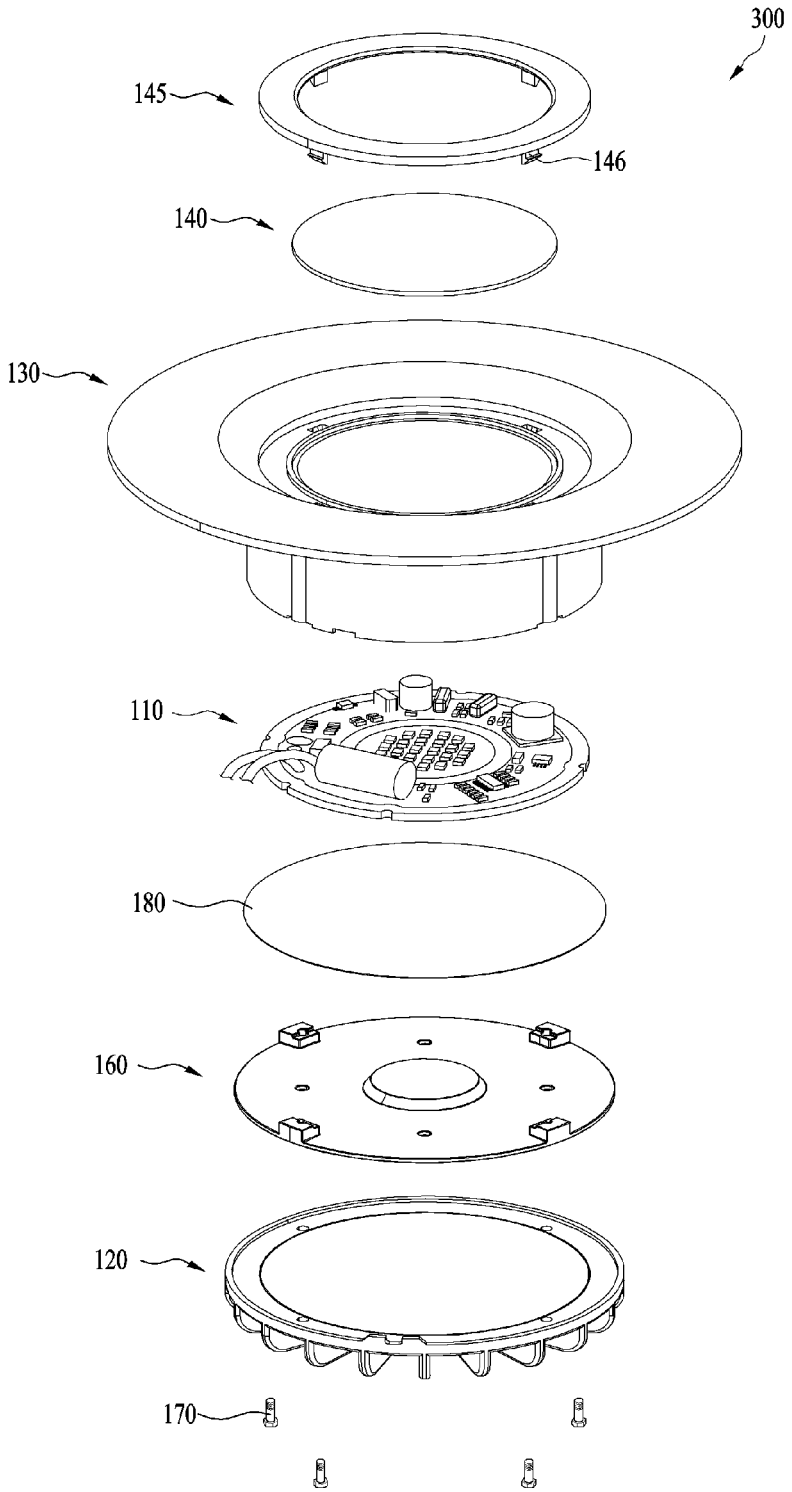
FIG. 13 is an exploded perspective view of a lighting device according to a further embodiment.

FIG. 13 is an exploded perspective view of a lighting device 300 according to a further embodiment. The same numerals as the numerals used in FIG. 1 denote the same components, and a description thereof is briefly given or omitted.

Referring to FIG. 13, the lighting device 300 further includes an insulation sheet 180, in addition to the components of the embodiment shown in FIG. 1.

The insulation sheet 180 may be disposed between the board 112 and the heat dissipation pad 160 so as to prevent electrical contact between the soldered portions 112-5 and the heat dissipation pad 160, thereby further improving the insulation property therebetween.

FIG. 14 illustrates an insulation sheet 185 according to another embodiment.

Referring to FIG. 14, the insulation sheet 185 may have an opening 190 corresponding to the first region 112*a* of the board 112, and may be disposed between the second region 112*b* of the board 112 and the heat dissipation plate 162.

The projecting portion 164 of the heat dissipation pad 160 is brought into direct contact with the lower surface of the first region 112*a* of the board 112 through the opening 190 in the insulation sheet 185, thereby improving the efficiency of heat dissipation. Furthermore, since the soldered portions 112-5 formed in the second region 112*b* of the board 112 are insulated from the heat dissipation plate 162 by means of the insulation sheet 185, electrical contact between the soldered portions 112-5 and the heat dissipation pad 160 is prevented, thereby improving the insulation property therebetween.

The insulation sheet 180 shown in FIG. 13 and the insulation sheet 185 shown in FIG. 14 may also be applied to the embodiment shown in FIG. 12. In other words, in other embodiments, the insulation sheet 180 or 185 may further be disposed between the board 112 and the heat dissipation pad 160*a* shown in FIG. 13.

The features, configurations, effects and the like described above in the embodiments are included in at least one embodiment, but are not necessarily limited to only one embodiment. In addition, the features, configuration, effects and the like exemplified in the respective embodiments may be combined with other embodiments or modified by those skilled in the art. Accordingly, content related to these combinations and modifications should be construed as falling within the scope of the embodiments.

INDUSTRIAL APPLICABILITY

The embodiments may be applied to a lighting device, which is capable of preventing shortening of life of drive elements attributable to heat generated from heat-emitting elements and of preventing an electrical short between drive elements bonded to the lower surface of a board.

The invention claimed is:

1. A lighting device comprising:

a light-emitting module including a board, at least one light-emitting element disposed in a first region of the board and a drive element disposed in a second region of the board so as to drive the at least one light-emitting element, wherein the second region of the board surrounds the first region of the board and is on a same plane as the first region of the board;

a heat dissipation member disposed under a lower surface of the board; and a heat dissipation pad disposed between the board and the heat dissipation member, wherein the heat dissipation pad comprises:

a heat dissipation plate disposed on an upper surface of the heat dissipation member;

a projecting portion projecting from an upper surface of the heat dissipation plate so as to support a lower surface of the first region of the board; and support protrusions disposed on the upper surface of the heat dissipation plate and spaced apart from the projecting portion, wherein the support protrusions directly contact and support a peripheral portion of the board, wherein each of the support protrusions includes an upper surface and a stepped portion, which is a flat surface having a difference in height with respect to the upper surface of the support protrusion, so as to directly contact and support the peripheral portion of the board having the at least one light-emitting element and the drive element disposed thereon, and wherein the lower surface of the board is spaced apart from the heat dissipation plate.

2. The lighting device according to claim 1, wherein the drive element is bonded to the lower surface of the board, and a portion of the drive element that is bonded to the lower surface of the board is spaced apart from the upper surface of the heat dissipation plate.

3. The lighting device according to claim 2, wherein the board is a double-sided printed circuit board that is provided on upper and lower surfaces thereof with respective circuit patterns.

4. The lighting device according to claim 3, wherein the drive element includes a leg penetrating the second region of the board, and wherein the board includes a solder portion provided on a lower surface of the second region of the board, and the solder portion is bonded to the leg of the drive element and the circuit pattern formed at the lower surface of the board.

5. The lighting device according to claim 4, wherein the solder portion is spaced apart from the upper surface of the heat dissipation plate.

6. The lighting device according to claim 4, wherein the solder portion is disposed in a space defined between the projecting portion and the support protrusions.

7. The lighting device according to claim 1, wherein the heat dissipation pad includes first through holes, each of which is formed through a corresponding one of the support protrusions and the heat dissipation plate.

8. The lighting device according to claim 7, wherein the board includes second through holes corresponding to the first through holes, and each of the second through holes of the board is configured to be recessed from a peripheral edge of the board and has a semicircular shape.

9. The lighting device according to claim 8, further comprising first coupling members, each of which penetrates a corresponding one of the first through holes and a corresponding one of the second through holes so as to couple the board to the heat dissipation plate.

10. The lighting device according to claim 7, wherein each of the support protrusions includes a stepped surface disposed between the upper surface and the stepped portion, and each of the first through holes is formed in a boundary surface between the stepped surface and the stepped portion.

11. The lighting device according to claim 1, further include an insulation sheet disposed between the board and the heat dissipation pad.

12. The lighting device according to claim 11, wherein the insulation sheet includes an opening corresponding to the first region of the board and is disposed between the second region of the board and the heat dissipation plate, and wherein the projecting portion is brought into contact with the lower surface of the first region of the board through the opening of the insulation sheet.

13. The lighting device according to claim 1, wherein the first region includes a center of the board and is a central region within a predetermined range about the center of the board, and the second region is a region spaced apart from the first region by a first distance and from a peripheral edge of the board by a second distance.

14. The lighting device according to claim 1, wherein each of the support protrusions includes a shoulder for contacting and supporting the peripheral portion of the board.

15. The lighting device according to claim 1, wherein the board includes third through holes positioned in the first region and the projecting portion the heat dissipation pad includes coupling holes corresponding to the third through holes, and further includes a second coupling member being fastened into the coupling holes through the third through holes.

16. The lighting device according to claim 1, wherein a height of the stepped portion from the upper surface of the heat dissipation plate is the same as a height of the projecting portion.

17. The lighting device according to claim 1, wherein a diameter of the projecting portion gradually increases toward a lower surface of the projecting portion from an upper surface of the projecting portion.

18. A lighting device comprising:

a board including a first region, a second region, a third region between the first region and the second region, and a fourth region positioned between the second region and a peripheral edge of the board;

at least one light-emitting element disposed in the first region of the board;

a drive element disposed in the second region of the board so as to drive the at least one light-emitting element;

a heat dissipation member disposed under a lower surface of the board; and a heat dissipation pad disposed between the board and the heat dissipation member, wherein the heat dissipation pad comprises:

a heat dissipation plate disposed on an upper surface of the heat dissipation member;

a projecting portion projecting from a central area of an upper surface of the heat dissipation plate so as to support a lower surface of the first region of the board; and support protrusions disposed on the upper surface of the heat dissipation plate and spaced apart from the projecting portion, wherein each of the support protrusions includes an upper surface and a stepped portion, which is a flat surface having a difference in height with respect to the upper surface of the support protrusion, wherein the first region includes a center of the board and is a central region within a predetermined range about the center of the board, and the second region is a region spaced apart from the first region by a first distance and from the peripheral edge of the board by a second distance, wherein the second region of the board surrounds the first region of the board and is on a same plane as the first region of the board, and wherein the stepped portions of the support protrusions support and directly contact a lower surface of the board having the at least one light-emitting element and the drive element disposed thereon.

19. A lighting device comprising:

a board including a first region, a second region, a third region between the first region and the second region, and a fourth region positioned between the second region and a peripheral edge of the board;

at least one light-emitting element disposed in the first region of the board;

a drive element disposed in the second region of the board so as to drive the at least one light-emitting element;

a heat dissipation member disposed under a lower surface of the board; and a heat dissipation pad disposed between the board and the heat dissipation member, wherein the heat dissipation pad comprises:

a heat dissipation plate disposed on an upper surface of the heat dissipation member;

a projecting portion projecting from a central area of an upper surface of the heat dissipation plate so as to support a lower surface of the first region of the board; and support protrusions disposed on the upper surface of the heat dissipation plate and spaced apart from the projecting portion, wherein each of the support protrusions includes an upper surface and a stepped portion, which is a flat surface having a difference in height with respect to the upper surface of the support protrusion, so as to directly contact and support the peripheral portion of the board having the at least one light-emitting element and the drive element disposed thereon, wherein the first region includes a center of the board and is a central region within a predetermined range about the center of the board, and the second region is a region spaced apart from the first region by a first distance and from the peripheral edge of the board by a second distance, wherein the second region of the board surrounds the first region of the board and is on a same plane as the first region of the board, wherein the drive element includes a leg penetrating the second region of the board, and wherein the board includes:

a circuit pattern on a lower surface of the second region; and a solder portion provided on the lower surface of the second region, wherein the solder portion is bonded to the leg of the drive element and the circuit pattern.

* * * * *